United States Patent [19]

Ishigami

[11] 4,092,012

[45] May 30, 1978

[54] RATCHET TYPE QUICK FEEDING MECHANISM FOR AUTOMOBILE PANTOGRAPH JACK

[75] Inventor: Hiroyuki Ishigami, Yokohama, Japan

[73] Assignee: Otsuka Koki Co., Ltd., Yokohama, Japan

[21] Appl. No.: 825,766

[22] Filed: Aug. 18, 1977

[30] Foreign Application Priority Data

Mar. 18, 1977 Japan ..... 52-1977

[51] Int. Cl.[2] ..... B66F 3/08

[52] U.S. Cl. ..... 254/126

[58] Field of Search ..... 254/126, 122, 98

[56] References Cited

U.S. PATENT DOCUMENTS 1,612,124 12/1926 Huelsich ..... 254/98

1,774,926 9/1930 Kruse ..... 254/126

1,888,761 11/1932 Foyer ..... 254/126

FOREIGN PATENT DOCUMENTS 67,285 7/1948 Denmark ..... 254/122

*Primary Examiner*—Robert C. Watson

*Attorney, Agent, or Firm*—Wender, Murase & White

[57] ABSTRACT

A ratchet type quick feeding mechanism for an automobile pantograph jack including a round bar having a ratchet screw portion, a pawl member for engaging the teeth of the ratchet screw portion, a connecting block carrying a horizontal shaft on which the pawl member is pivotally supported, and pantograph link assemblies for changing the height of the jack by horizontal shift of the connecting block.

2 Claims, 3 Drawing Figures

RATCHET TYPE QUICK FEEDING MECHANISM FOR AUTOMOBILE PANTOGRAPH JACK

SUMMARY OF THE INVENTION

The present invention relates to a quick feeding mechanism for a pantograph type jack used to lift the body of the automobile on occasions such as when a tire of the automobile is to be changed.

In the conventional pantograph type automobile jack, where the body of an automobile is lifted to change a tire or to mount a tire chain by positioning the jack under a jacking point of the body of the automobile, a feeding screw bar mechanism must be rotated for a considerable time without load while the jack moves from its folded position in low profile to a vertically extended position against the jacking point.

During this time, since the posture of the jack itself is unstable, extra labor is required to hold the jack in place. As a result, the user of the jack is easily frustrated and feels unsafe.

An object of the present invention is to provide a quick feeding mechanism for a pantograph type jack capable of saving time and labor in bringing the height of the jack to a level at which the body of an automobile is first contacted and subsequently lifted.

The above and other objects will more fully appear from the following description in connection with the accompanying drawings.

DESCRIPTION OF THE PREFERRED EMBODIMENTS

Figure 1:
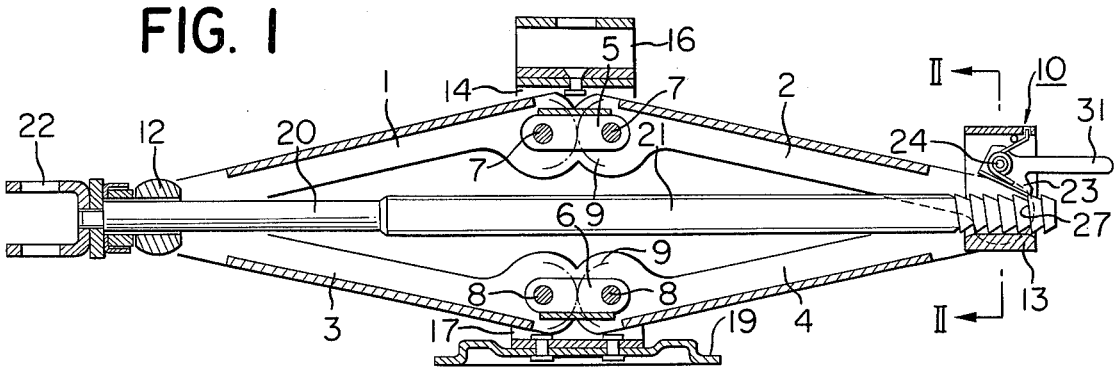
FIG. 1 is a vertical cross-sectional side view of a preferred embodiment of a pantograph type automobile jack having a ratchet type quick feeding mechanism according to the present invention.

In the drawings, the pantograph type jack according to the present invention has an overall construction similar to that of a conventional pantograph type jack except for a ratchet mechanism identified generally by reference numeral 10 in FIG. 1. For purposes of completeness of the description, a summary of the overall jack structure is described hereinbelow.

Figure 2:
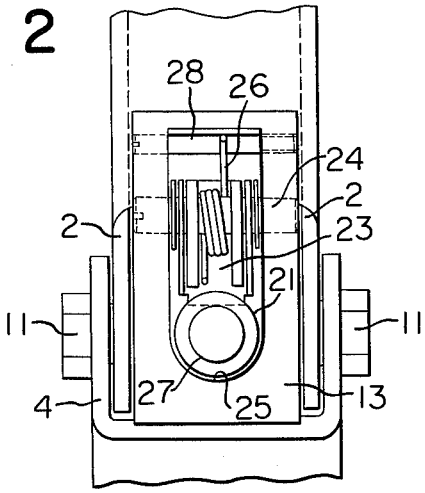
FIG. 2 is a cross-sectional view taken along line II—II of FIG. 1.

The pantograph assembly of this invention has links 1, 2, 3, and 4 and each link is preferably a grooved or channel-like member having a U-shaped cross section. This is best illustrated in FIG. 2, numeral 4, and in FIG. 1, in longitudinal cross section. The pairs of horizontal connecting links 1, 2 and 3, 4 are connected by intermediate connectors 5 and 6, respectively, having U-shaped cross sections and connecting pins 7, 7 and 8, 8 as shown in FIG. 1. Both link pairs 1, 2 and 3, 4 are assured of right and left symmetrical motions by the gear-like meshing 9 of mutual contact portions (schematically illustrated by broken lines).

Also, the connection between upper and lower links, namely, between links 1 and 3, the links 2 and 4, is accomplished by pivotally mounting connecting pins 11, 11 (FIG. 2) between the links. The connecting pins 11, 11 are fixed to the connecting blocks 12 and 13. The connecting block 12 in the lefthand portion of FIG. 1 forms a bearing block through which a round, smooth surfaced bar portion 20 of the ratchet screw bar of the pantograph type jack penetrates. The righthand connecting block 13 forms an enclosure block housing the ratchet mechanism 10 according to the present invention.

At the top portion of the pantograph assembly, there are provided an outside connecting body 14 supported on the outside of the links 1 and 2 by connecting pins 7, 7 and a jacking piece 16 mounted on the connecting body 14 by a suitable pin or rivet. Also, at the bottom portion of the pantograph assembly, there are provided an outside connecting body 17 vertically aligned below the upper connecting body 14 and a support base 19 mounted directly underneath body 17 by means of suitable pins or rivets.

A generally U-shaped handle mounting frame 22 is fixedly attached to the lefthand end of bar 20 and is provided with holes for accommodating a rotating handle (not shown) in the normal mode. On the righthand side of bar 20, a ratchet type screw thread portion 21 is formed, only the end threads being illustrated for clarity.

Figure 3:
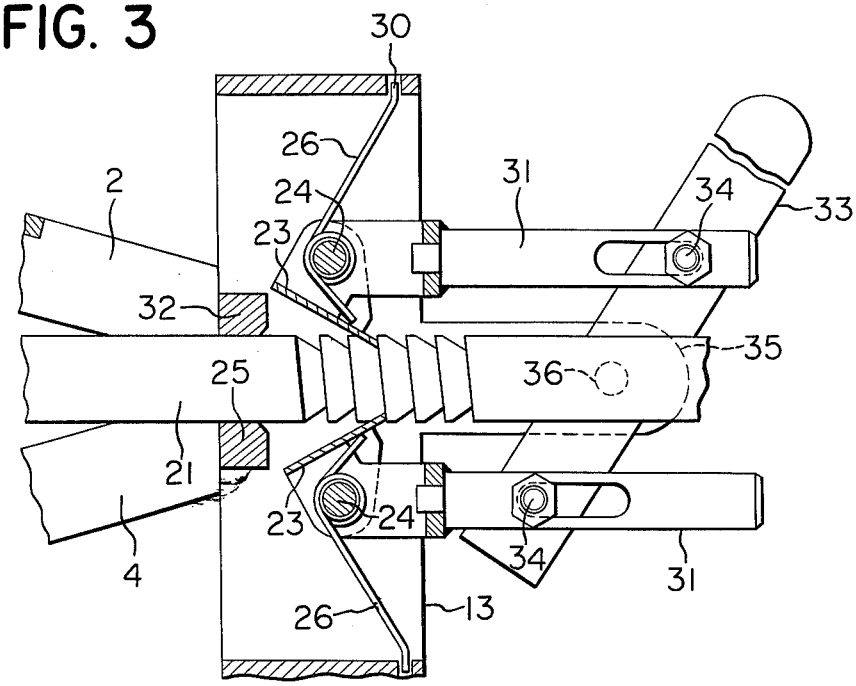
FIG. 3 is a vertical cross-sectional side view, in detail, of another embodiment of the quick feeding ratchet mechanism of the present invention.

The ratchet screw portion 21 of bar 20 extends through the ratchet mechanism 10 according to the present invention, and is engaged with a strong pawl member 23 pivotally fixed to the enclosure 13. In the embodiment of FIG. 1, the side of the ratchet bar 21 opposite pawl 23 is supported slidably by a semicylindrical bearing surface 25 of the enclosure block 13. As shown in FIG. 2, the pawl member 23 is supported on a sturdy horizontal shaft 24 mounted in the enclosure block 13, and is pressed into contact with a root portion 27 of the ratchet screw 21 by a biasing spring 26. A fixed end of the biasing spring 26 is supported by a lateral bar 28 fixed to the enclosure block 13, but may be engaged with a hole 30 of the enclosure as shown in the embodiment of FIG. 3 to be described hereinbelow. A handle 31 integral with the pawl member 23 is provided so that the pawl can be rotated away from screw portion 21 by hand.

FIG. 3 is a detailed view showing another embodiment of the ratchet mechanism of the pantograph type jack according to the present invention. The embodiment of FIG. 3 is different from the embodiment of FIGS. 1 and 2 in that a pair of pawl members 23 similar to FIG. 1 are provided symmetrically in the vertical direction about the ratchet screw portion 21 of bar 20. In this case, in order to avoid instability of the center axis of the ratchet screw bar 21, it is preferable to provide a centering bearing 32 integral with the enclosure block 13. A pair of connecting pins 34, 34 are carried upon a bar 33 and are coupled slidably in the longitudinal direction to the manual handles 31 extending from each pawl member 23. Bar 33 is preferably supported on an intermediate pivot axle 36 mounted on a support bar 35 extending from the side of the enclosure block 13.

Also, if desired, three or more pawl members 23 may be disposed at axially symmetrical positions about the ratchet screw bar 20.

The ratchet type quick feeding mechanismm of the pantograph type jack according to the present invention having the foregoing construction operates in the following manner.

When the body of an automobile is to be lifted in order to change a tire, for example, the jack device according to the present invention is placed immediately beneath the jacking point of the automobile. The top 16 of the jack is then extended upwardly by moving the links 1, 2, 3, and 4 of the pantograph, and sliding the pawl member 23 of the ratchet mechanism 10 along the inclined surfaces of the threaded portion 21 of the ratchet bar 20. This is continued until the top member 16 engages the automobile whereupon the pawl member 23 fits into the root portion 27 of its adjacent ratchet tooth. In this manner, the pantograph jack is raised quickly by this arrangement, and thereafter the ratchet screw portion 21 is screwed into the pawl member 23 by turning the rotating handle. The pawl member 23 thus is drawn toward the left as visualized in FIG. 1, and accordingly, the link mechanism 1, 2, 3, 4 of the pantograph is raised and the body of the automobile is lifted.

When the lifting motion of the pantograph type jack is accomplished in reverse, it becomes its returning motion, but when the pantograph is released from the weight of the body of the automobile, it is possible to detach the pawl member 23 from the ratchet screw portion 21 by manipulating the manual handle 31. With the pawl 23 thus released, the enclosure block 13 is free to move toward the outside, and the pantograph mechanism can be restored to its initial folded position. In the embodiment of FIG. 3, rotation of bar 33 will cause both handles 31 to be moved away from bar 20 so as to release both pawl members 23 simultaneously.

As described in the foregoing, the ratchet type quick feeding mechanism of the pantograph type jack according to the present invention has been described in illustrative manner, but it is obvious to those skilled in the art that other modifications could be made by those skilled in the art without departing in spirit and scope from the invention as defined by the appended claims, such as by modifying the thickness of the pawl member or the shape of the tip and the root portions of the ratchet to suit existing conditions.

What is claimed is:

1. A ratchet type quick feeding mechanism for an automobile pantograph jack comprising a pantograph link assembly adjustable in height by relative horizontal movement of a pair of pivot assemblies disposed in diagonally opposite corners of said link assembly; a rotatable bar having a ratchet screw thread portion, said bar being disposed in fixed axial position in one of said pivot assemblies with the ratchet screw thread portion extending through the other of said pivot assemblies; a plurality of pawl members disposed on said other pivot assembly at axially symmetrical positions with respect to said bar, each of said pawl members engaging said ratchet screw thread portion of said bar, said pawl members and said ratchet screw thread portion cooperating to enable sliding movement of said pivot assemblies toward each other as well as screw advancement of said pivot assemblies by rotation of said bar; each of said pawl members including a handle for manually rotating said pawl members away from said bar to release the same; and said other pivot assembly further including an operator bar coupled to both of said handles of said pawl members for simultaneously releasing said pawl members.

2. A ratchet type quick feeding mechanism according to claim 1, wherein said operator bar is pivotally mounted on said other pivot assembly for rotation about an axis centered between said handles.

* * * * *